US012534253B2

(12) United States Patent
Spicker

(10) Patent No.: US 12,534,253 B2
(45) Date of Patent: Jan. 27, 2026

(54) PADDING STATION, PADDING SYSTEM, AND METHOD

(71) Applicant: Storopack Hans Reichenecker GmbH, Metzingen (DE)

(72) Inventor: Michael Spicker, Kempen (DE)

(73) Assignee: Storopack Hans Reichenecker GmbH, Metzingen (DE)

( * ) Notice: Subject to any disclaimer, the term of this patent is extended or adjusted under 35 U.S.C. 154(b) by 0 days.

(21) Appl. No.: 18/588,688

(22) Filed: Feb. 27, 2024

(65) Prior Publication Data

US 2024/0294289 A1 Sep. 5, 2024

(30) Foreign Application Priority Data

Mar. 1, 2023 (DE) ..... 10 2023 105 085.0

(51) Int. Cl.
*B65B 55/20* (2006.01)
*B65B 57/10* (2006.01)
*B65B 65/00* (2006.01)

(52) U.S. Cl.
CPC ..... *B65B 55/20* (2013.01); *B65B 57/10* (2013.01); *B65B 65/003* (2013.01)

(58) Field of Classification Search
CPC ..... B65B 55/20; B65B 57/10; B65B 65/003; B65B 57/12
USPC ..... 53/428
See application file for complete search history.

(56) References Cited

U.S. PATENT DOCUMENTS

| | | | | |
|---|---|---|---|---|
| 7,814,733 | B2 * | 10/2010 | Carlson | B65B 55/20 53/472 |
| 9,828,128 | B1 * | 11/2017 | Linnell | B65B 57/00 |
| 2008/0092488 | A1 * | 4/2008 | Gabrielsen | B65B 55/20 53/115 |
| 2020/0180804 | A1 * | 6/2020 | Slovencik | B65B 61/22 |

FOREIGN PATENT DOCUMENTS

| | | | |
|---|---|---|---|
| DE | 102011055455 | A1 | 5/2013 |
| DE | 102021117821 | A1 | 1/2023 |
| EP | 3574468 | B1 | 3/2023 |

OTHER PUBLICATIONS

DE10 2023 105 085.0 Search Report dated Feb. 8, 2024.

* cited by examiner

*Primary Examiner* — Robert F Long
*Assistant Examiner* — Xavier A Madison
(74) *Attorney, Agent, or Firm* — Wood Herron & Evans LLP

(57) ABSTRACT

A method comprises determining sensor information which is associated with a shipping box pre-packed with at least one shipping product, the determined sensor information characterizing a position of each unused space within the shipping box; conveying the shipping box out of an inlet segment and into a padding segment; providing a plurality of padding items of different types and/or sizes in a dispensing segment according to the determined sensor information; receiving each of the plurality of padding items provided in the dispensing segment; and arranging each of the received padding items in one of the free unused spaces within the shipping box according to the determined sensor information.

30 Claims, 9 Drawing Sheets

Fig. 15

R

K

| | | |
|---|---|---|
| #1 | P_800b | P_920b |
| #2 | P_800c | P_920b |
| #3 | P_800a | P_920a |

PADDING STATION, PADDING SYSTEM, AND METHOD

This application claims the priority benefit of German Patent Application No. DE 10 2023 105 085.0 filed Mar. 1, 2023, which is hereby incorporated by reference herein as if fully set forth in its entirety.

The invention relates to advances in the area of padding for shipping products in shipping boxes.

In distribution centers, for e-commerce applications, small to middle-size boxes, used as shipping boxes, are filled with a plurality of different shipping products, which usually already have a certain degree of robustness owing to their primary packaging, and are secured by the packer inserting suitable padding means and/or protective packaging, for example paper pads or air cushion bags, sufficiently so that they survive the further transport up to the end customer without damage.

The problems of the prior art are resolved by a padding station according to claim 1, by a padding system according to an independent claim, and by a method according to a further independent claim.

One aspect of the description relates to the following subject matter: A padding station comprising a sensor device; a conveying device, a plurality of padding means dispensers which are configured to provide padding means of different types and/or different sizes in at least one dispensing segment; a handling system; and a control unit which is configured to carrying out the following, together with the sensor device, the conveying device, the plurality of padding means dispensers, and the handling system: determining sensor information which is associated with at least one pre-packed shipping box, which is pre-packed with at least one shipping product, wherein the determined sensor information characterizes a position of each unused space within the at least one pre-packed shipping box; conveying the at least one pre-packed shipping box out of an inlet segment and into a padding segment; providing a plurality of padding means, in particular of different types and/or sizes, according to the determined sensor information associated with the at least one shipping box; receiving each of the plurality of provided padding means according to the determined sensor information; and arranging each of the plurality of provided padding means in one of the unused spaces within the at least one, pre-packed shipping box positioned in the padding segment, according to the determined sensor information.

By using the sensor information and the plurality of padding means dispensers, it is possible to arrange mutually different padding means in the shipping box in an automated manner.

With the plurality of padding means dispensers, it is possible to imitate the manipulation and/or variation by an experienced packer of the padding materials typically available at a padding station.

A method and/or a padding station is advantageously provided which can provide optimized padding material of different types and different lengths in a minimum number in order to create a sufficient protective effect for the shipping products contained in the shipping box during shipping.

Accordingly, the shipping products do not have to be sent individually to a recipient, but can be arranged in a single shipping box addressed to the recipient.

Advantageously, the padding means necessary for the protective effect can thus be reduced, while simultaneously increasing the protective effect. Consequently, cost advantages and environmental advantages arise. A link between the padding station and a goods management system can be omitted.

An advantageous example is characterized in that the conveying device comprises a fixing system which fixes the shipping box in the padding segment at a padding position at least during a period in which the at least one padding means is inserted into the associated unused space.

This prevents the shipping box from unintentionally moving out of the padding position when the padding means is pushed into the empty unused space with a press-in force.

An advantageous example comprises a hold-down device for fixing the at least one shipping product in the shipping box, at least during the arrangement of the at least one padding means.

Advantageously, the shipping product is accordingly held in its position, and unintentional displacement of the shipping product within the shipping box is prevented or reduced. The padding process is accordingly facilitated.

An advantageous example comprises a separating segment arranged downstream of the padding segment in the direction of flow for receiving shipping boxes and a pusher which conveys the at least one shipping box into the separating segment if a fault is detected in relation to the shipping box is detected.

This allows for subsequent verification or subsequent padding by hand.

An advantageous example is characterized in that at least one machine-trained function operates the conveying system, the plurality of padding means dispensers, and the handling system according to the sensor information associated with the pre-packed shipping box.

One aspect of the description relates to the following subject matter: A padding system comprising at least one, in particular a plurality of, padding stations according to the above-described aspect.

An advantageous example is characterized in that at least two padding stations are connected in succession.

An advantageous example is characterized in that at least two padding stations are connected in parallel with one another.

A third aspect of the description relates to the following subject matter: A method comprising the steps of: determining sensor information which is associated with a pre-packed shipping box, which is pre-packed with at least one shipping product, wherein the determined sensor information characterizes a position of each unused space within the at least one pre-packed shipping box; conveying the at least one pre-packed shipping box out of an inlet segment and into a padding segment; providing a plurality of padding means, in particular of different types and/or sizes, in at least one dispensing segment according to the determined sensor information associated with the at least one shipping box; receiving each of the plurality of padding means dispensers provided in the at least one dispensing segment according to the determined sensor information, and arranging each of the received items of the plurality of padding means in one of the free unused spaces within the at least one pre-packed shipping box positioned in the padding segment according to the determined sensor information.

An advantageous example comprises determining at least one padding configuration associated with the pre-packed shipping box according to the sensor information; wherein the provision of the at least one padding means, the receiving of the at least one padding means, and the arranging of the at least one padding means are carried out according to the determined padding configuration.

By determining the padding configuration, a sequence of padding steps is advantageously defined.

An advantageous example is characterized in that the determination of the at least one padding configuration comprises: determining at least one first data set of at least one padding means parameter relating to the padding means to be provided, and at least one unused space parameter relating to the associated unused space of the shipping box; determining at least one target degree of conformity between the determined at least one padding means parameter and the at least one unused space parameter; comparing the first data set and the at least one target degree of conformity with a previously determined second data set which comprises at least one previously determined padding means parameter and at least one unused space parameter, and also contains an actual degree of conformity associated with the second data set; and selecting the determined first data set for carrying out a padding if the comparison indicates a sufficient padding quality, or again determining the first data set and the target degree of conformity if the comparison does not indicate a sufficiently good padding quality.

Dynamic feedback for decision optimization is advantageously provided, and quality control takes place after the paired assignment of padding means to gaps and/or empty unused space. A drop in the padding quality is thus effectively prevented.

An advantageous example is characterized in that at least one machine-trained function determines the at least one padding configuration associated with the pre-packed shipping box according to the at least one piece of sensor information.

The use of a machine-trained function results in advantages in determining the padding configuration. On the one hand, padding objectives optimized to the customer's wishes can thus be realized. On the other hand, the high complexity in the arrangement of protective packaging with the machine-trained function can be mapped to the padding station and/or its operation.

An advantageous example is characterized in that the determination of the at least one padding configuration comprises: determining a plurality of padding configurations and corresponding confidence values associated therewith, in particular by means of differently machine-trained and/or differently configured functions, in particular differing in their structure; selecting a padding configuration from the plurality of padding configurations according to the confidence values, in particular selecting the padding configuration with the highest confidence value; wherein the provision of the at least one padding means, the receiving of the at least one padding means, and the arranging of the at least one padding means are carried out according to the selected padding configuration.

An advantageous example comprises determining the corresponding availability of padding means of the plurality of padding means dispensers; wherein the determination of the at least one padding configuration associated with the pre-packed shipping box is additionally carried out according to the determined availability of padding means.

It is accordingly advantageously achieved that the padding means configuration takes place in a manner matching the padding means available at the padding station. On the one hand, this accordingly makes it possible to prevent a padding means configuration from being determined which cannot be implemented due to a lack of padding means starting material. On the other hand, this also makes it possible to provide a trained function that successfully covers a plurality of complex padding scenarios.

An advantageous example is characterized in that the padding configuration comprises one or more padding steps arranged in a time sequence, wherein one of the padding steps comprises at least one padding parameter relating to the padding means to be provided, and an unused space parameter, in particular relating to the position within the empty unused space in which the at least one associated padding means to be provided should be inserted.

An unambiguous instruction is thus advantageously present for the arrangement of the padding means or protective packaging by means of the padding station.

An advantageous example is characterized in that the method comprises: determining and checking a confidence value which represents an estimate for the actual applicability of the determined padding configuration to the pre-packed shipping box, in particular according to the at least one piece of sensor information; providing, receiving and arranging the at least one padding means if the confidence value indicates the applicability of the padding configuration, or separating out the pre-packed shipping box in a separating segment if the confidence value does not indicate applicability of the padding configuration.

Advantageously, padding means are thus arranged in the shipping box only if the confidence value indicates this. Damage to the shipping products can thus be prevented. It is further ensured that the shipping box can be closed without problems in the subsequent closing station.

An advantageous example comprises determining and checking a padding quality associated with the at least one padding means arranged in the shipping box according to the at least one further piece of sensor information; transporting the shipping box to an output segment for transfer to a subsequent station if there is sufficient padding quality, or separating out the shipping box provided with padding means in a separating segment if there is insufficient padding quality.

A separating mechanism is thus created in order to allow manual inspection of shipping boxes that are potentially poorly or insufficiently padded.

An advantageous example is characterized in that the determination of the padding quality associated with the at least one padding means comprises: determining an actual degree of conformity between at least one padding parameter relating to the provided padding means and the associated unused space parameter relating to the unused space associated with the padding means.

Feedback for future padding processes can be created with the degree of conformity and its storage.

An advantageous example is characterized in that the receiving of the at least one padding means comprises: determining a gripping pose, wherein the gripping pose comprises the gripping of a gripper of the handling system in a segment of the padding means which is opposite a planned insertion segment of the padding means for insertion into the associated unused space; and gripping the at least one padding means according to the determined gripping pose.

Advantageously, the padding means is thus already gripped to match the associated unused space, i.e. on the side of the padding means that is opposite the opening of the unused space for the insertion into the unused space.

An advantageous example is characterized in that the arrangement of the at least one padding means comprises: determining a first trajectory starting from a receiving position, in which the padding means was gripped by the handling system in the at least one dispensing segment, to an intermediate position, in which the gripped padding means is situated in front of an outer opening of the associated free unused space; determining a second trajectory starting from the intermediate position to an end position in which the padding means is arranged within the associated unused space; moving the gripped padding means along the first trajectory to the intermediate position; and moving the gripped padding means along the second trajectory.

Advantageously, the padding means can thus be positioned in two movement steps, so that, for example, a force measurement takes place during the travel of the second trajectory, since this force measurement also determines the quality of the padding.

An advantageous example comprises determining and checking an actual counterforce during the movement along the second trajectory; and moving the gripped padding means along the second trajectory as long as the actual counterforce lies below a counterforce threshold value, or terminating the movement along the second trajectory if the determined actual counterforce exceeds the counterforce threshold value.

This can then successfully prevent the shipping product or the shipping box from being damaged by the insertion of the padding means.

An advantageous example comprises fixing, in particular holding down, the at least one shipping product which bounds the free unused space, at least during the movement of the gripped padding means along the second trajectory.

Advantageously, the shipping product remains in place and does not slip inadvertently.

A fourth aspect of the description relates to the following subject matter: A padding station or a padding system comprising a plurality of padding stations designed to carry out the method according to the third aspect.

In the drawing:

FIGS. 11 to 14 show sensor information associated with a shipping box, and the padding of the shipping box; and FIG. 15 shows a padding configuration relating to the shipping box of FIGS. 11 to 14.

Figure 1:
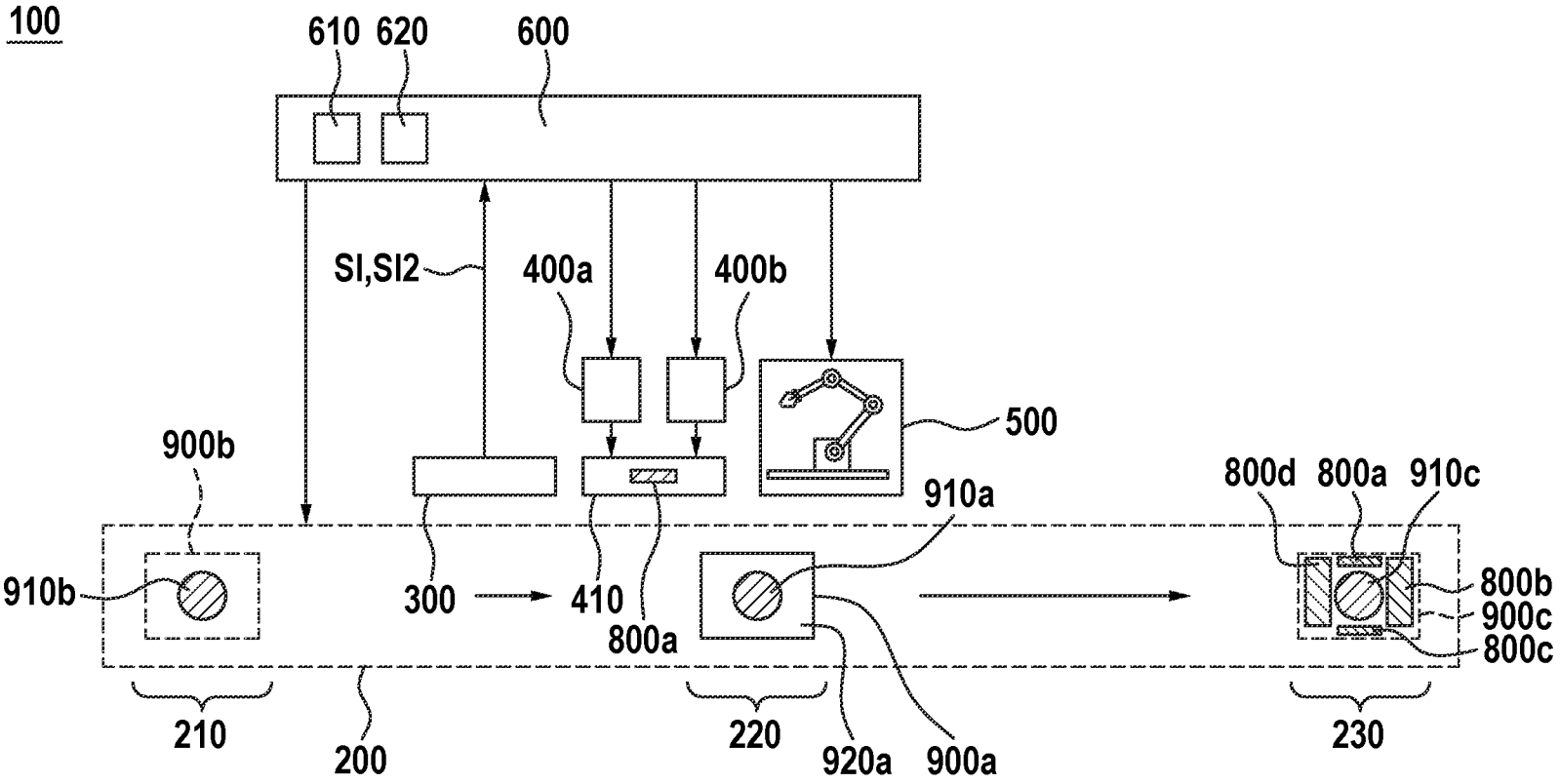
FIG. 1 is a schematic view of a padding station.
Figure 3:
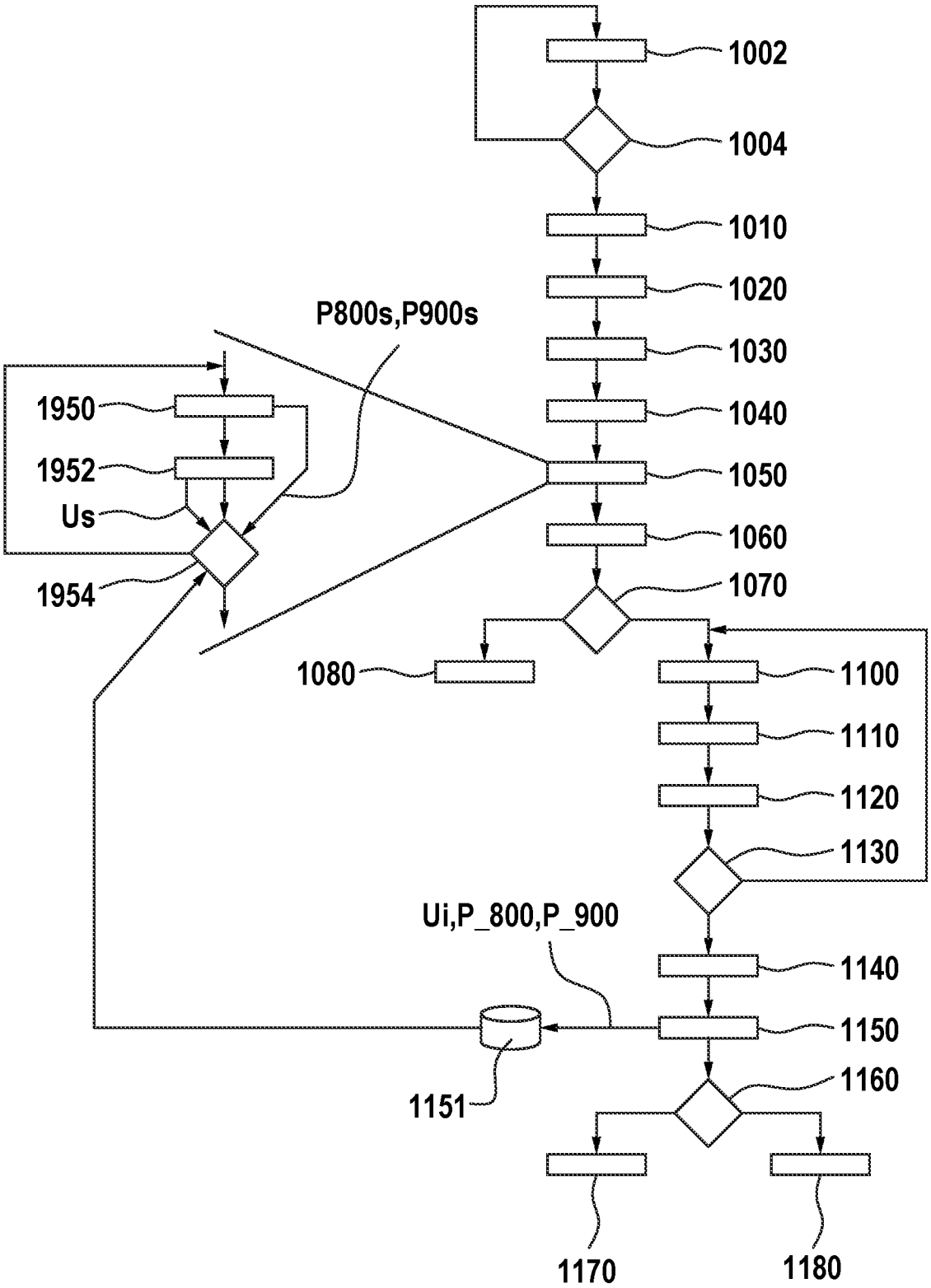
FIG. 3 is a schematic flowchart of a method for operating the padding station.

Reference is made below to FIGS. 1 and 3. FIG. 1 shows a schematic illustration of a padding station 100. FIG. 3 shows a flowchart of a method for operating the padding station 100.

A conveying device 200 is configured to receive at least one shipping box 900 pre-packed with a shipping product 9010 in an inlet segment 210 of the conveying device 200, to convey the at least one pre-packed shipping box 900 from an inlet segment 210 to a padding segment 220 of the conveying device 200 and hold it there, and subsequently to transport the pre-packed shipping box 900 provided at least partially with a padding means 800*a-d* from the padding segment 220 to an output segment 230 of the conveying device 200.

The pre-packed shipping box 900 can, for example, already be provided with the product 910, and optionally additionally with a padding means inserted in advance. Accordingly, the measures described here are also applied to the shipping box 900 mentioned above with the shipping product 910 and the padding means. Accordingly, a pre-existing padding means is detected and treated as a shipping product. In one embodiment, the padding means already arranged in the shipping box is detected as such and further processed with corresponding parameters.

A plurality of padding means dispensers 400 is configured to provide padding means 800 of different types and/or different sizes in at least one dispensing segment 410. The padding means dispensers 400 are designed, for example, in such a way that they can provide different lengths of the padding means with a fixed width and fixed height. Padding means 800 is also referred to as protective packaging. The padding means 800 are used to block the shipping products 910 within the shipping box 900 and to pad them ("block and brace").

A handling system 500 is configured to receive at least one padding means 800 provided in the at least one dispensing segment 410 and to arrange it in the at least one empty unused space 920 within the at least one pre-packed shipping box 900 positioned in the padding segment 220 of the conveying device 200.

A control unit 600 is configured to equip or provide the at least one shipping box 900 with padding means 800 with the aid of a sensor device 300, the conveying device 200, the plurality of padding means dispensers 400, and the handling system 400.

The control unit 600 comprises at least one processor 610 and a memory unit 620. The methods described here are stored in the memory unit 620 as a computer program product. The computer program product can be executed on the processor 610.

According to a step 1002, there is a monitoring of whether the at least one pre-packed shipping box 900 arrives in the inlet segment. This is verified in step 1004. If the shipping box 900 has been accepted in the inlet region, the method moves to step 1010. If no shipping box is detected, the method moves to step 1002.

After the at least one pre-packed shipping box 900 has been received 1010 in the inlet segment 210, a determination 1030, by means of the sensor device 300, of sensor information SI which is associated with a pre-packed shipping box 900, which is pre-packed with the at least one shipping product 910, takes place, wherein the determined sensor information SI characterizes a position of each unused space 920 within the at least one pre-packed shipping box 900.

For example, a three-dimensional image is captured by means of a stereo camera as a sensor device 300. Object contours for the inner walls and the shipping products 910 arranged in the shipping box 900 can thus be created from the three-dimensional image. These object contours associated with the shipping box 900 provide an input variable for a function which determines a padding configuration associated with the shipping box 900.

The determination 1030 of the sensor information SI comprises both a detection of the dimensions of the shipping box 900 and a detection of an internal topography of the shipping box 900, a detection of a content type, such as, for example, an estimate of the breakability of the shipping product 910 and of gap features or unused space parameters. A single or a plurality of individual sensors can be used. The gap features comprise, for example, information regarding the position and size, in particular the volume, of the gap or the free unused space 920. In a further development, the gap features also comprise information about the breakability of the shipping products 910 adjacent to the gap. Of course, the sensor information SI can be processed in intermediate steps in order, for example, to transfer gap features comprising a position and size to the machine-trained function for determining the padding configuration.

The at least one pre-packed shipping box 900 is conveyed 1020 from the inlet segment 210 to the padding segment 220. The determination 1030 of the sensor information SI depends on the position of the corresponding sensor, which is why the conveying 1020 can take place temporally upstream or downstream.

A corresponding availability V of padding means 800 of the plurality of padding means dispensers 400 is determined 1040, wherein a temporally subsequent determination 1050 of the at least one padding configuration K associated with the pre-packed shipping box 900 is additionally carried out according to the determined availability V of padding means 800.

Figure 7:
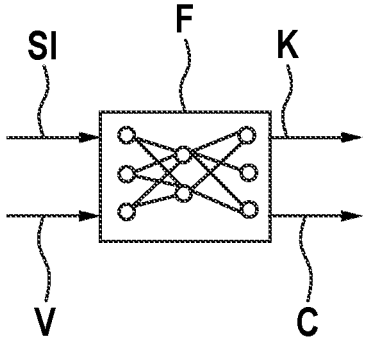

According to the example of FIG. 7, the availability V is supplied to the machine-trained function Fin order to determine the padding configuration K adapted to the available padding means types and associated with the at least one shipping box 910.

The determination 1050 of at least one padding configuration K associated with the pre-packed shipping box 900 thus takes place according to the sensor information SI. The provision 1100 of the at least one padding means 800, the receiving 1110 of the at least one padding means 800, and the arrangement 1120 of the at least one padding means 800 are carried out according to the determined padding configuration K.

In one example, the evaluation of the sensor information SI and thus also of the gap features or unused space parameters takes place by outputting the padding configuration K in step 1050, wherein the determination 1050 of the at least one padding configuration K comprises: determining 1950 at least one first data set of at least one padding means parameter P_800*s* relating to the padding means to be provided and at least one unused space parameter P_900*s* relating to the associated unused space of the shipping box 900; determining 1952 at least one target degree of conformity Us between the determined at least one padding means parameter P_800*s* and the at least one unused space parameter P_900*s*; comparing 1954 the first data set and the at least one target degree of conformity Us with a previously determined second data set which comprises at least one previously determined padding means parameter P_800*s* and at least one unused space parameter P_900*s*, and an actual degree of conformity Ui associated with the second data set; and selecting the determined first data set for carrying out a padding if the comparison indicates a sufficient padding quality, or again determining the first data set and the target degree of conformity Us if the comparison does not indicate a sufficiently good padding quality.

In one example, the actual or target degree of conformity is a maximum force which was or must be applied to the associated unused space for insertion of the padding means. Alternatively or additionally, the actual or target degree of conformity represents a positive or negative dimension which results from the subtraction of the padding means dimension and unused space dimension.

Of course, the feedback from previously performed padding can also be omitted during operation of the padding station, or be designed differently.

For example, the feedback can take place by training data being generated during operation of the padding station 100. The function for determining the padding configuration is trained with the specific training data.

The machine-trained function F in one of FIG. 6 to FIG. 10 determines 1050 the at least one padding configuration K associated with the pre-packed shipping box 900 according to the at least one piece of sensor information SI. Of course, instead of a machine-trained function, a differently designed, for example deterministic, operating function can also be used.

When determining a padding configuration K, for example, a target degree of conformity between the gap features of an empty unused space and the padding features or parameters of the available padding types is compared. If a high degree of conformity is determined, the associated padding parameters are linked to the unused space. The unused space parameters and the padding parameters associated therewith are provided as a padding step. Each padding step comprises a result regarding which padding means is to be inserted into which unused space or into which gap according to the associated padding parameters.

One of the unused space parameters is, for example: an inner dimension such as width, height, length of the unused space; an inner contour of the unused space, a required protection factor of at least one of the shipping products; or an indicator of the accessibility of the unused space to be filled with padding means.

One of the padding parameters is, for example: an outer dimension such as width, height, length of a padding means to be produced; a density of a padding means; a degree of damping of a padding means to be produced; or a flexibility of a padding means to be produced.

Figure 6:
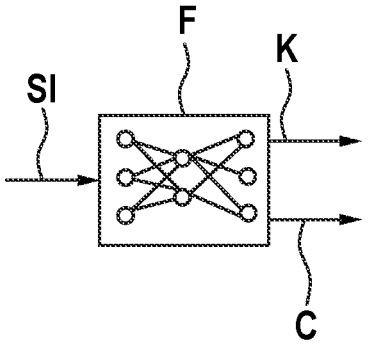
FIGS. 6 to 8 show examples of a machine-trained function.
Figure 8:
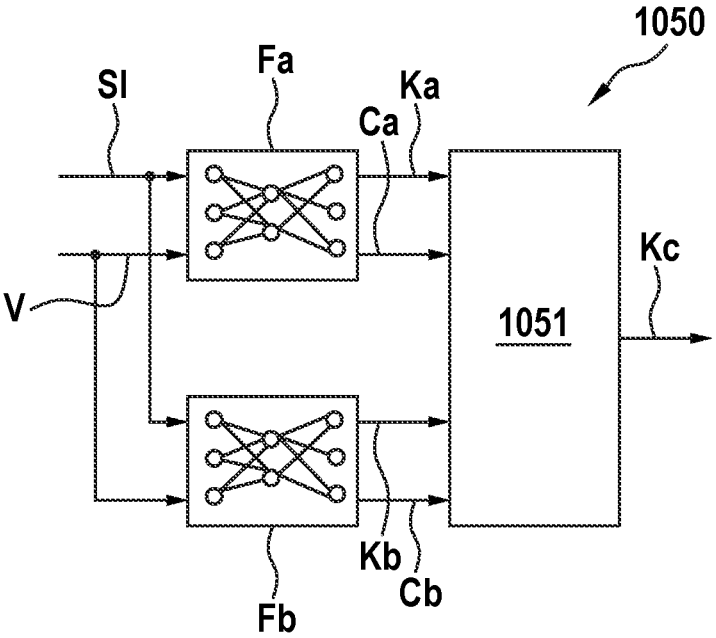

According to FIG. 3 and one of FIGS. 6 to 8, a confidence value C is determined 1060 and checked 1070, which represents an estimate of the actual applicability of the determined padding configuration K to the pre-packed shipping box 900, in particular according to the at least one piece of sensor information SI.

According to FIG. 3 and FIGS. 6 to 8, at least one machine-trained function F is used in order to operate the conveying device 200, the plurality of padding means dispensers 400 and the handling system 500 according to the sensor information SI associated with the pre-packed shipping box 900.

After provision 1100 of at least one of the plurality of padding means 800, in particular of different types and/or sizes, according to the padding configuration, in at least one dispensing segment 410, the corresponding of the plurality of padding means 800 provided in the at least one dispensing segment 410 is received 1110 according to the determined sensor information SI and the received item of the plurality of padding means 800 is arranged 1120 in one of the free unused spaces 920 within the at least one pre-packed shipping box 900 positioned in the padding segment 220 according to the determined sensor information SI.

The provision 1100, receiving 1110, and arrangement 1120 are carried out according to the determined sensor information SI associated with the at least one shipping box 900, in particular according to a determined padding configuration K, which is determined according to the sensor information SI.

The provision 1100, receiving 1110 and arrangement 1120 of the at least one padding means 800 is then done if the confidence value indicates the applicability of the padding configuration K. The pre-packed shipping box 900 is then separated out 1080 in a separating segment 240 if the confidence value does not indicate applicability of the padding configuration K.

In a step 1130, it is checked whether a further padding step must take place according to the determined padding configuration. If this is the case, the method moves to step 1100. If it is determined in step 1130 that no further padding steps have to be carried out, the arrangement of padding means in the padding station 100 is concluded.

A determination 1140 of a further piece of sensor information SI2 associated with the at least one shipping box 900 follows, which characterizes at least one position of at least one padding means 800 arranged in the unused space 920 of the shipping box 900.

The further piece of sensor information SI2 comprises, for example, a further digital image of the shipping box 900 and/or a counterforce determined in the region of the handling system 500 when the padding means 800 is inserted into the empty unused space.

A padding quality associated with the at least one padding means 800 is determined 1150 and checked 1160 according to the at least one further piece of sensor information SI2. The shipping box 900 is transported 1170 to an output segment 230 for transfer to a subsequent station if there is sufficient padding quality. However, the shipping box 900 provided with padding means 800 is separated out 1180 in a separating segment 240 if there is insufficient padding quality.

The determination 1150 of the padding quality associated with the at least one padding means 800 comprises determining an actual degree of conformity Ui between at least one padding parameter P_800 relating to the provided padding means 800 and the associated unused space parameter P_900 relating to the unused space 900 associated with the padding means 800.

Associated data sets comprising at least one padding parameter P_800, at least one unused space parameter P_900, and at least one actual degree of conformity Ui are then available in the memory unit 1151. These data sets can be used for future training, thus providing training data.

Figure 2:
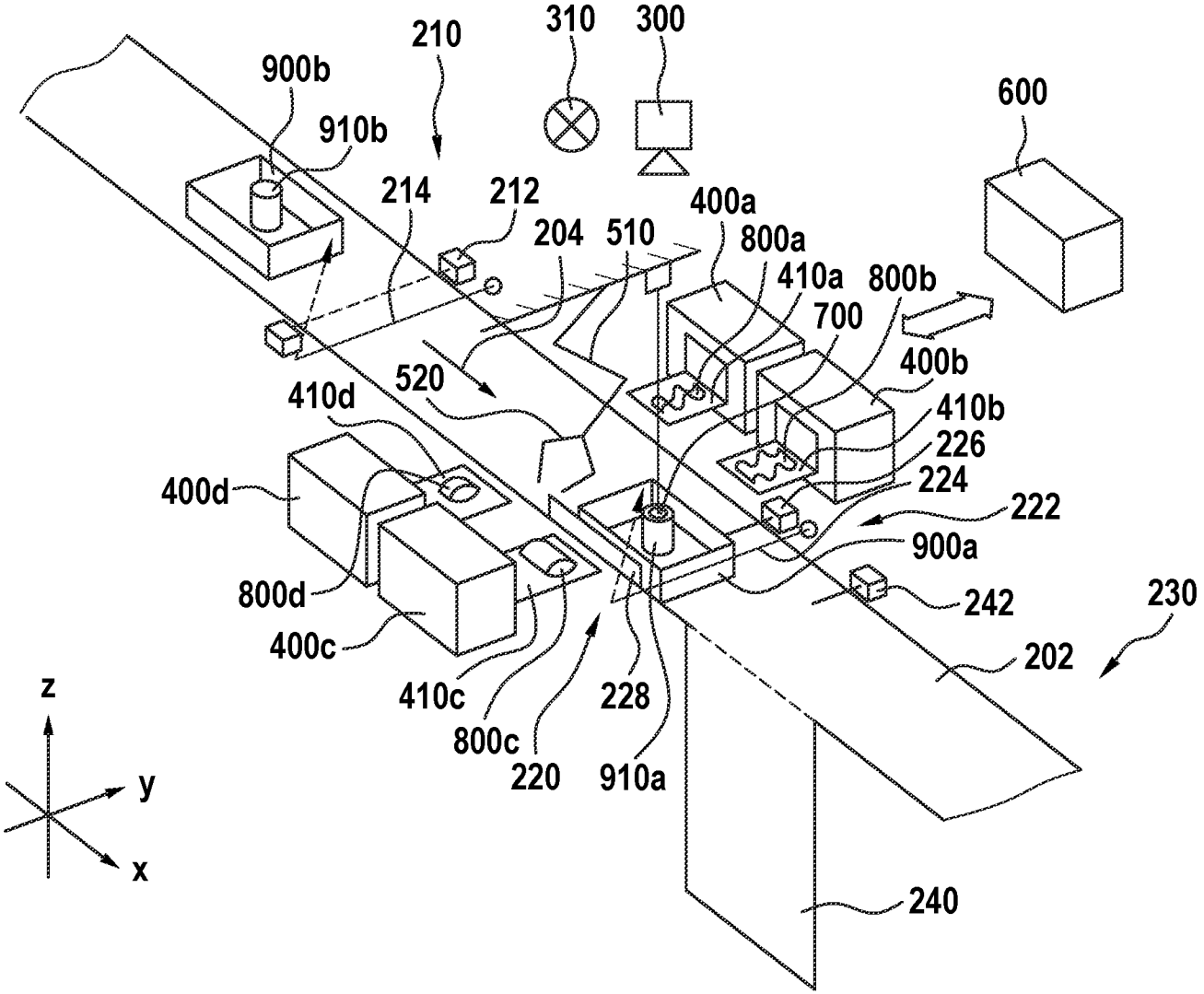
FIG. 2 shows an example of the padding station in a perspective schematic view.

FIG. 2 shows an example of the padding station 100 from FIG. 1. The conveying device 200 comprises, for example, a roller conveyor and further elements controlling the flow of the shipping boxes 900.

A light barrier 212 registers an arrival of a shipping box 900 in the inlet segment 210. If the padding station 100 is ready to receive a further shipping box 900, the gate 214 shown schematically as a barrier is opened.

The sensor device 300 comprises, for example, a camera for capturing a digital image. The camera is directed toward the opening of the shipping box 900 which exposes the view of the interior of the shipping box 900, so that in the digital image the arrangement of shipping products 910, the arrangement of the inner walls of the shipping box 900 and the arrangement of the unused spaces between the inner wall and one of the shipping products 910 or between a plurality of shipping products 910 are contained as information. A lighting device 310, which radiates light in the direction of the opening of the shipping box 900, is associated with the sensor device 300.

In the example shown, the padding means dispensers 400*a-b* provide a padding means 800*a-b* designed as a paper pad in different widths. The padding means dispensers 400*c-d* provide a padding means 800*c-d* designed as an air cushion pad in different widths.

A supply of starting material for producing a paper pad as a padding means comprises, as in the case of the padding means dispensers 800*a-b*, for example, sheet-like material which is provided in a compact form, such as by means of a roller made of sheet-like material or a sheet-like material that is folded from a zigzag-folded sheet-like material by means of a rectangular stack.

In a further example according to the padding means dispensers 800*c-d*, the starting material comprises plastic film and is provided in a compact form, for example by means of a roll. The plastic film is converted into bags and inflated by compressed air and closed off.

Further examples (not shown) of padding means dispensers comprise, for example, dispensers for foam padding means or pourable individual padding means.

In one example, a sensor is provided in the corresponding padding means dispenser 400 in order to individually recognize an end of the starting material for producing the corresponding padding means 800 and/or an end of the availability of a padding means type, individually for each padding means dispenser.

The elements referred to as padding means in this description can alternatively also be referred to as protective packaging or protective packaging means. Accordingly, other terms based on the term padding means, such as padding means configuration or padding means parameters, can also be referred to as protective packaging means configuration or protective packaging parameters.

In the example shown, the handling system 500 comprises a robot arm 510 fixed to a ceiling above the conveying device 200 and a robot hand 520 as a gripping device. Alternatively or additionally, a vacuum gripper can be used instead of the robot hand.

The conveying device 200 comprises a fixing system 222 which fixes the shipping box 900 in the padding segment 220 at a padding position at least during a period in which the at least one padding means 800 is inserted into the associated unused space 920.

In the example shown, the fixing system 222 comprises a gate 224, shown schematically as a barrier, which stops the shipping box 900 conveyed in a conveying direction 204 via the conveying device 202.

A pusher 226 pushes the stopped shipping box 900 against a wall 228 opposite the pusher 226, whereby the padding position of the shipping box 900 in the padding segment 220 is reached.

In a further example, the handling system 500 comprises a hold-down device 700 for holding down the products delimiting the empty unused space in order to prevent unintentional displacement of the products during the insertion of the padding means. The hold-down device 700 fixes the at least one shipping product 910 in the shipping box 900 at least during the arrangement of the at least one padding means 800.

The schematically shown hold-down device 700 is fixed horizontally above the padding segment 220 and can also be designed as a robot arm with a distal fixing end.

A pusher 242 is provided which pushes the at least one shipping box 900 into the separating segment 240 if a fault is detected in relation to the shipping box 900.

The pusher 242 is controlled by the control unit 600 to move the shipping box 900 into the separating segment 240 if the padding quality was evaluated as insufficient. From the separating segment 240, the shipping boxes 900 are manually removed, inspected, re-padded by hand if required, and then fed back to the inlet segment 210. Automatic re-padding may then take place; or, sufficient padding is detected by the control unit 600, and the shipping box 900 is provided in the output segment 230 for forwarding to a closing station for closing the shipping box 900.

Figure 4:
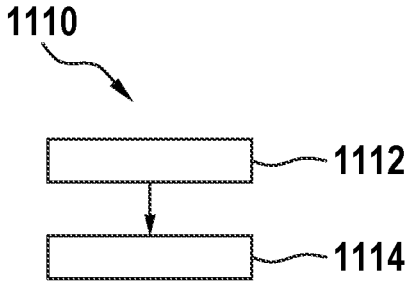
FIGS. 4 and 5 are further schematic flowcharts.

In FIG. 4, the receiving 1110 of the at least one padding means 800 is described in more detail with reference to FIGS. 1 and 2. The receiving 1110 comprises determining 1112 a gripping pose, wherein the gripping pose comprises gripping by a gripper 520 of the handling system 500 in a segment of the padding means 800 which is opposite a planned insertion segment of the padding means 800 for insertion into the associated unused space 920. The receiving 1110 comprises gripping 1114 the at least one padding means 800 according to the determined gripping pose.

Figure 5:
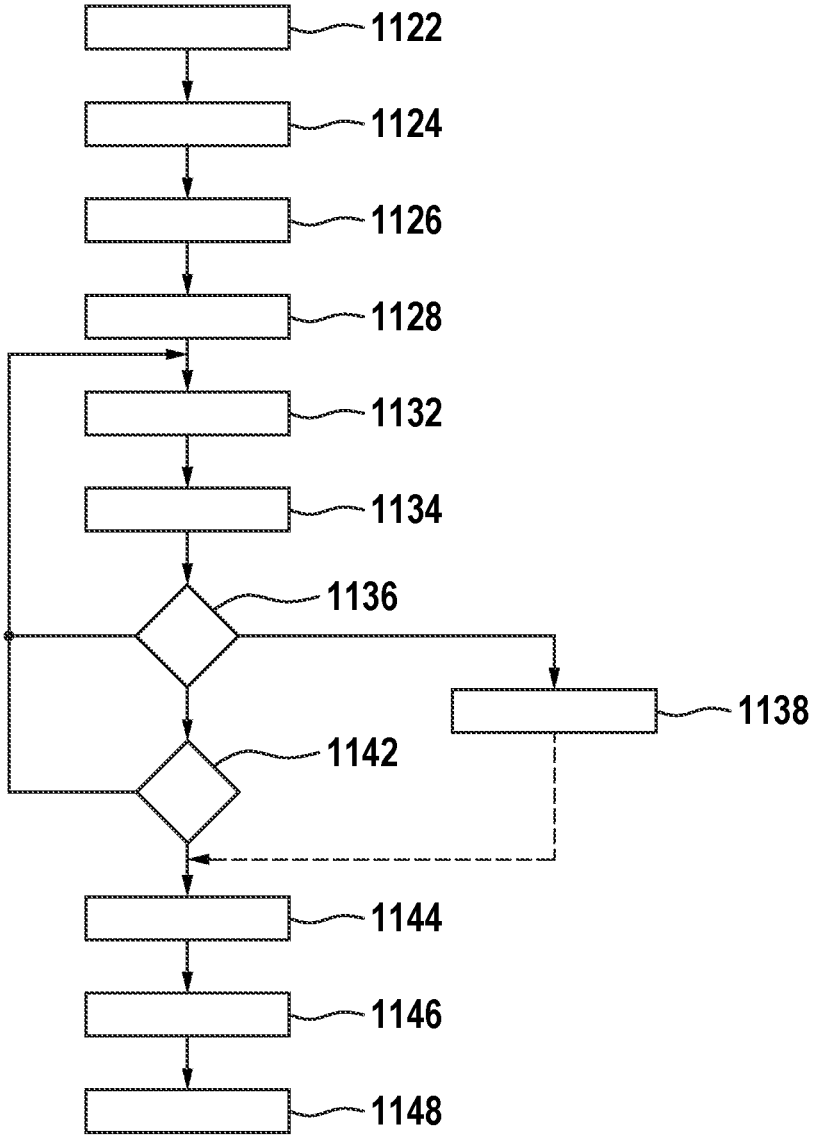

According to FIG. 5, arranging 1120 the at least one padding means 800 comprises determining 1122 a first trajectory starting from a receiving position in which the padding means was gripped by the handling system 500 in the at least one dispensing segment 410, to an intermediate position in which the gripped padding means 800 is located in front of an outer opening of the associated free unused space 920. Subsequently, a second trajectory is determined 1124 starting from the intermediate position to an end position in which the padding means 800 is arranged within the associated unused space 920. Subsequently, the gripped padding means 800 is moved 1126 along the first trajectory relative to the intermediate position. After the movement 1126, a movement 1132 of the gripped padding means 800 takes place along the second trajectory.

Subsequently, an actual counterforce is determined 1134 and checked 1136 during the movement 1132 along the second trajectory. The movement 1132 of the gripped padding means 800 along the second trajectory takes place as long as the actual counterforce, which is exerted by the shipping box 900 via the padding means 800 into the handling system 500, is below a counterforce threshold value previously stored or determined individually for the unused space. The movement 1132 along the second trajectory is terminated 1138 if the determined actual counterforce exceeds the counterforce threshold value.

The termination 1138 can indicate sufficient padding, allowing the method to move to step 1144. In step 1144, the padding means 800 is released.

In step 1142, it is checked whether the end position of the second trajectory has been reached. If this is not the case, the method moves to step 1132. If this is the case, the gripper 520 allows the padding means 800 to be released, and the padding means 800 is located at the desired end position of the second trajectory.

A fixing 1128, in particular holding down, of the at least one shipping product, which limits the free unused space 920, takes place at least during the movement 1128 of the gripped padding means 800 along the second trajectory. The fixing 1128 can also be omitted.

The method comprises releasing 1146 the fixation of the shipping products which are arranged around the unused space which is filled with at least one padding means, as soon as the corresponding padding means arranged in the unused space is released from the handling system 500.

The method comprises a movement and/or displacement 1148 of the gripper for the padding means along a third trajectory to a rest position or for gripping a further padding means.

FIG. 8 shows a further example for determining 1050 the padding configuration K, Kc, wherein the determination 1050 comprises: determining a plurality of padding configurations Ka, Kb and corresponding confidence values Ca, Cb associated therewith, in particular by means of differently machine-trained and/or differently configured functions Fa, Fb; and selecting 1051 a padding configuration Kc from the plurality of padding configurations Ka, Kb according to the confidence values Ca, Cb, in particular selecting the padding configuration Ka with the highest confidence value Ka. The provision 1100 of the at least one padding means 800, the receiving 1110 of the at least one padding means 800, and the arrangement 1120 of the at least one padding means 800 are carried out according to the selected padding configuration K.

Figure 9:
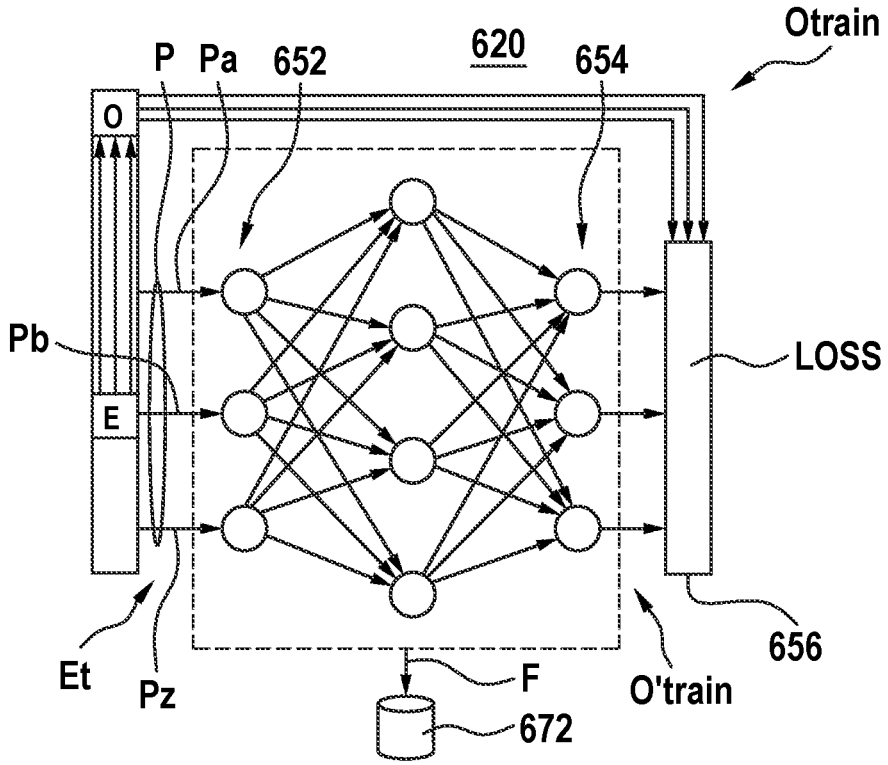
FIGS. 9 and 10 show examples of training and operation of the machine-trained function.

An apparatus 650 for the training of a model and/or the function F is shown in FIG. 9. Training data Et, for example comprising sensor information SI and at least one associated padding configuration K, are provided.

The arrangement comprises the artificial neural network with an input layer 652. For a time step i, an input tensor of the input E is transferred to the input layer. For input E, the output O is determined in the form of a classification or prediction which, for example, comprises a padding configuration and an associated confidence parameter or value, or is previously known. From the output O, in time step i, a tensor with observed values Otrain is determined, which values are associated with the observed values of the tensor Et. Each of the time series of the input E is assigned to one of three input nodes. At least one hidden layer follows the input layer in a forward path of the artificial neural network. A number of nodes of the at least one hidden layer is greater in the example than a number of the input nodes. This number is to be regarded as a hyperparameter and is preferably determined separately. In the example, four nodes are provided in the hidden layer. The artificial neural network is trained, for example, by the method with a gradient descent in the form of back propagation. The training of the model or the function F is thus monitored.

In the forward path, an output layer 654 is provided after the at least one hidden layer in the example. Prediction values are output at the output layer 654. In the example, an output node is associated with each prediction value.

In each time step i, a tensor O'train is determined, in which the prediction values are contained for this time step i. In the example, this is supplied to a training device 656 together with the column vector of the observed values Otrain. The training device 656 is designed in the example to determine a prediction error by means of a loss function LOSS, in particular by means of a mean square error, and to train the model M with it by means of an optimizer, in particular an Adam optimizer. In the example, the loss function LOSS is determined according to a deviation, in particular the mean square error from the values of the tensor of the observed values Otrain and the tensor of the prediction values O'train.

The training is terminated as soon as a fixed criterion has been reached. In the example, the training is terminated when the loss no longer decreases over a plurality of time steps, i.e., in particular, the mean square error does not decrease.

Test data are then input into the model trained in this way and/or into the trained function F. The function F is generated by the training with the training data. The function F is evaluated with the test data, in particular with regard to mean value u and covariance Σ.

Figure 10:
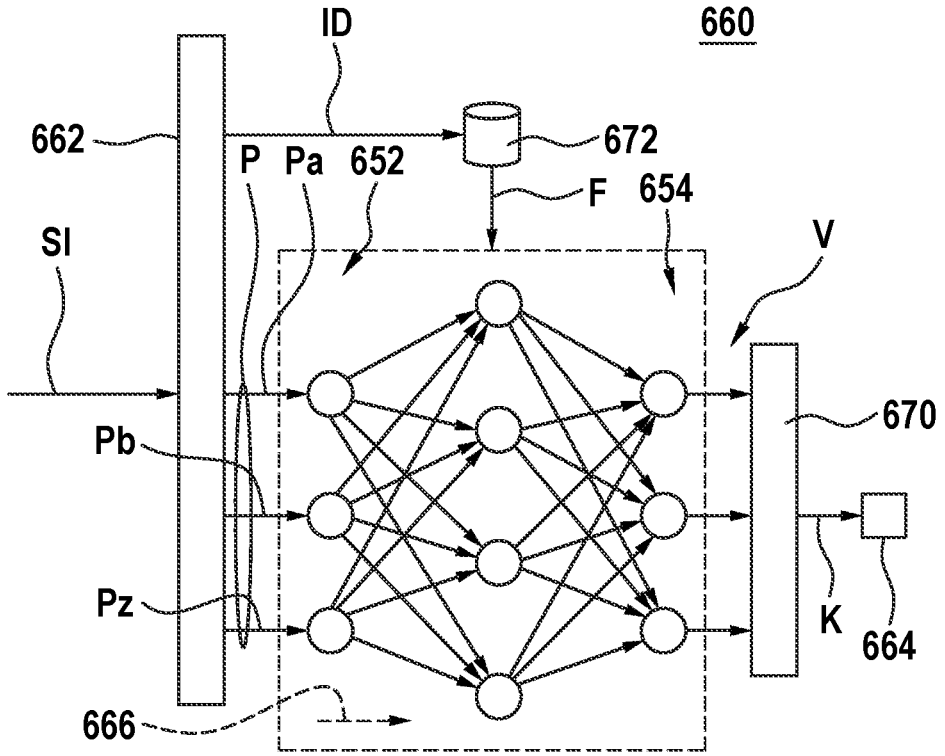

FIG. 10 shows a device 660 for determining a padding configuration K. An input interface 662 serves to receive the at least one piece of sensor information SI associated with at least one pre-packed shipping box, or data derived therefrom.

The machine-trained function F is used to determine the padding configuration K. The padding configuration K is determined according to the received sensor information SI. An output interface 664 serves to transmit or provide the determined padding configuration K.

The plurality of parameters Pa-z determined on the basis of the sensor signals SI are propagated 666 by the trained function F in the form of the artificial neural network. For this purpose, the parameters Pa-z are provided in an input region 652 of the function F, wherein a prediction V is provided in an output region 654 of the function. A classifier 670 determines the padding configuration K according to the prediction V.

An identifier ID is transmitted together with the plurality of sensor signal parameters Pa-z, wherein the function F is selected from a plurality of functions stored in the data memory 672 for determining the padding configuration K via or by means of the identifier ID.

The trained function F is used to provide the prediction V for the classification for the parameters P provided. For this purpose, the same data preprocessing steps are carried out as for the training data. For example, a scaling and a determination of input and output data takes place. This determination takes place in the example during operation of the padding station.

As described for the training, a column vector of the input E in the form of the provided parameters P is transmitted to the input layer 652 for a time step i. In contrast to the training of the classification device or the classifier 670, a classification of the supplied parameters is then carried out according to the prediction values V.

The results determined for the operation of the padding station are transferred, for example, in the form of the padding configuration K to the output interface for further processing by the padding station.

A confidence value associated with the padding configuration and determined in parallel by the function F indicates, for example, a quality of the determined padding configuration. If this exceeds a threshold value, a padding instruction that can be implemented at the padding station is available. The threshold value is preferably a further parameter.

In particular, instructions of a computer program that implement the functions described are provided for carrying out the described methods.

Figure 11:
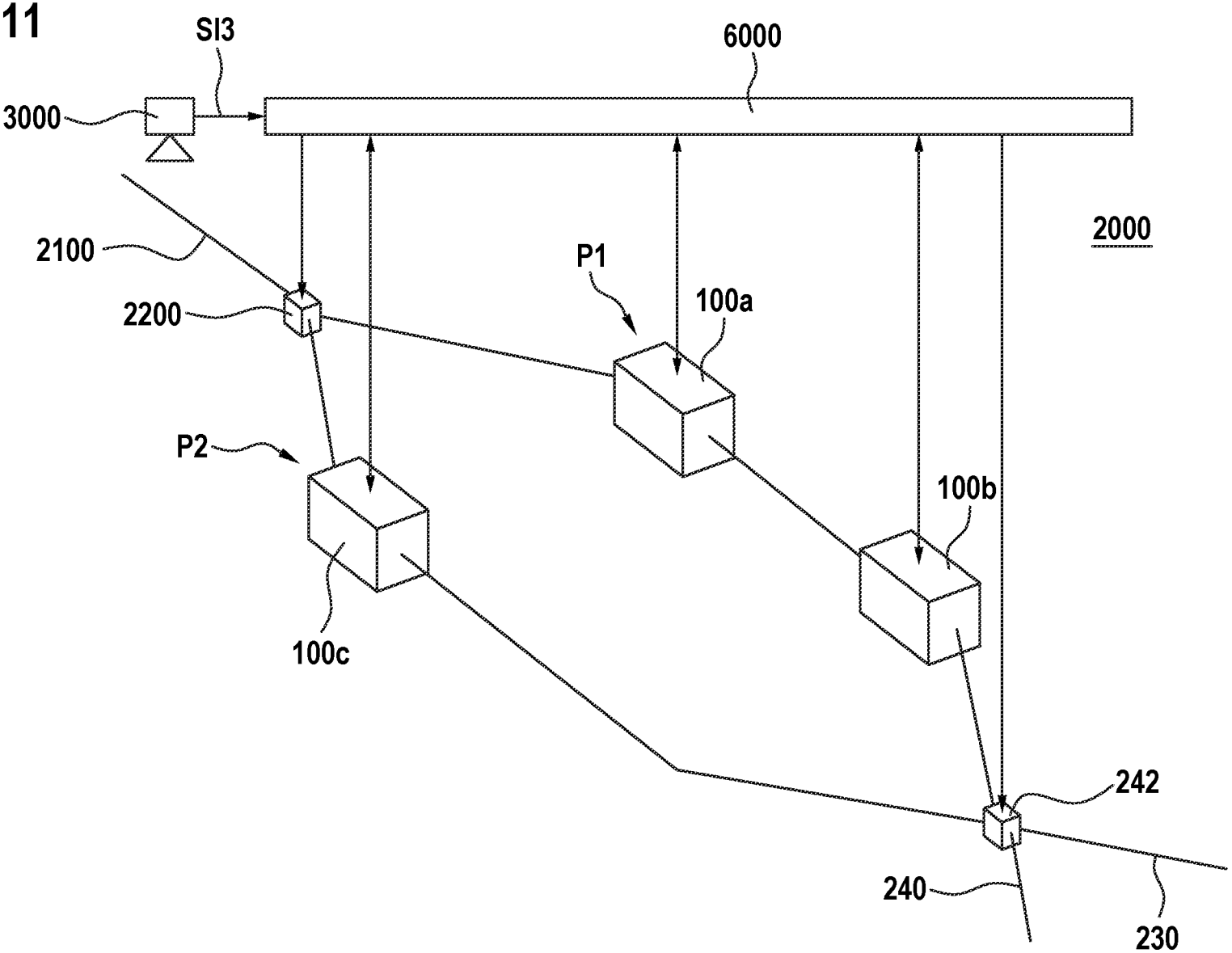
FIG. 11 shows an example of a padding system.

FIG. 11 shows a padding system 2000 in a schematic perspective view. Shipping boxes supplied via an inlet segment 2100 are detected by means of a sensor device 3000. The signals SI3 determined by the sensor device 3000 are supplied to a control unit 6000. The control unit 6000 decides, according to the supplied signals SI3 and the control of a switch 2200 dependent thereon, into which of the paths P1 and P2 a pre-packed shipping box located in the inlet segment 2100 will be directed. In the example shown, the path P1 comprises padding stations 100*a* and 100*b* connected in series. Only a single padding station 100*c* is located in the path P2. The individual padding stations 100*a-c* differ, for example, in the number of padding means types available. In one example, the control units of the padding station 100*a-c* are combined into the control unit 6000. The output segment 230 and the separating segment 240 can each be present singly/once for the system 2000 shown. Of course, separate output segments 230 and separating segments 240 are also conceivable.

Figure 12:
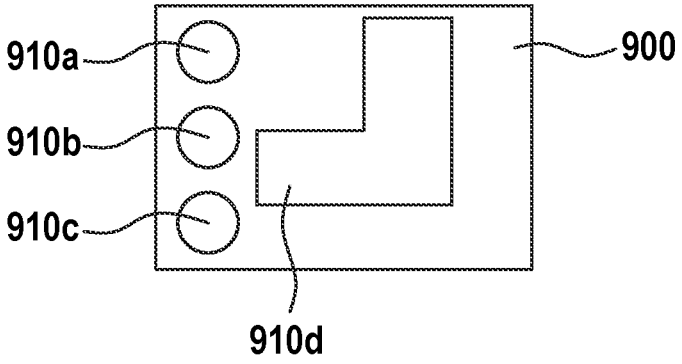

FIG. 12 shows the sensor information SI by way of example. In the present case, the sensor information SI is a digital two-dimensional image which has been captured from a plan view of the opened shipping box 900. The shipping products 910*a-d* have been arranged in the shipping box 900 according to a packaging specification that can be specified to the packer in a manual packaging step that was previously carried out.

Figure 13:
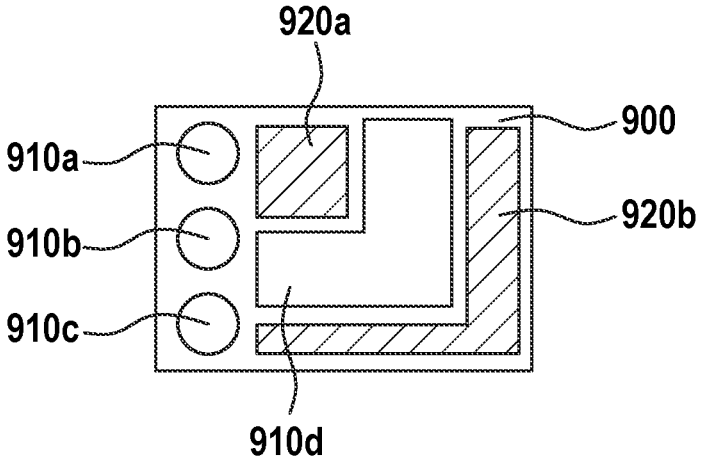

According to FIG. 13, the sensor information SI characterizes or comprises the position and size of the empty unused spaces 920*a-b*. The information about the position and size as well as further information relating to the corresponding unused space is inherent to the sensor information SI, i.e. contained in the sensor information SI.

Figure 14:
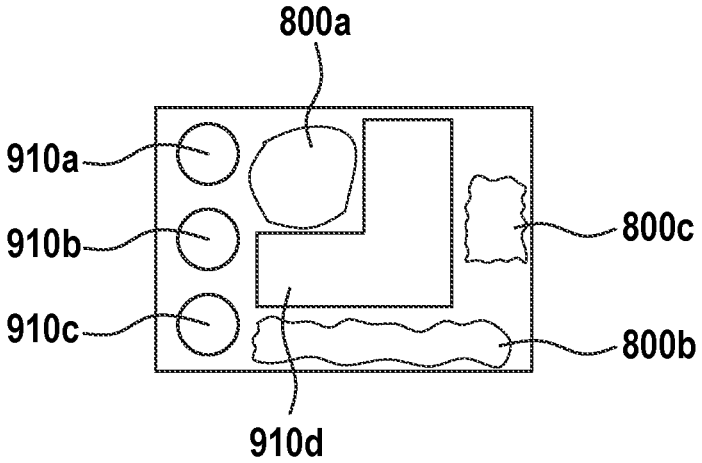

FIG. 14 shows the shipping box 900 from FIGS. 12 and 14, which is already provided with the padding means 800*a-c* according to the padding configuration K determined according to the sensor information SI. The padding means 800*a* is an air cushion pad. The padding means 800*b-c* are paper pads of the same width, but of different lengths. In the example, the padding means 800*c* does not fill the entire associated unused space 920*b*. The padding means 800*b*, in contrast, prevents slipping of the shipping product 910*c* and of the shipping product 910*d*.

The padding configuration K comprises one or more padding steps #1-#3 arranged in a temporal sequence R, wherein one of the padding steps #1-#3 comprises at least one padding parameter P_800 relating to the padding means 800 to be provided, and an unused space parameter P_920 in particular relating to the position within the empty unused space 920 at which the at least one associated padding means 800 to be provided should be inserted.

According to the padding configuration K of FIG. 15, the padding means 800*b* is first generated according to the padding means parameter P_800*b* and the unused space parameter P_920*b* and inserted into the unused space 920*b* of the shipping box 900 of FIG. 12-14, whereby undesired movement of the shipping products 910*b* and 910*c* is prevented. Subsequently, in step #2, the padding means 800*c* is produced according to the padding parameter P_800*c* as a paper pad with a length different from the padding means 800*b*, and is arranged in the unused space 920*b* according to the unused space parameter 920*b*. Movement of the shipping product 910*d* is thereby prevented. In step #3, the padding means 800*a* is produced as an air-filled film pad and is arranged in the unused space 920*a*. As shown in this example, the order of arrangement of the padding means plays a decisive role both for the successful padding process per se and for the desired degree of protection for shipping.

The invention claimed is:

1. A padding station, comprising:

a sensor device;

a conveying device;

a plurality of padding item dispensers;

a handling system; and a control unit which is configured to carrying out the following with the sensor device, the conveying device, the plurality of padding item dispensers, and the handling system:

determining sensor information which is associated with at least one pre-packed shipping box which is pre-packed with at least one shipping product, wherein the determined sensor information characterizes a position of each unused space within the at least one pre-packed shipping box;

conveying the at least one pre-packed shipping box out of an inlet segment and into a padding segment;

providing a plurality of padding items, of different types and/or sizes, according to the determined sensor information associated with the at least one shipping box;

receiving each of the plurality of provided padding items according to the determined sensor information; and arranging each of the plurality of padding items in one of the free unused spaces within the at least one pre-packed shipping box positioned in the padding segment according to the determined sensor information;

a separating segment arranged downstream of the padding segment in the direction of flow for receiving shipping boxes;

a pusher which pushes the at least one shipping box into the separating segment if a fault is detected in relation to the shipping box.

2. The padding station according to claim 1, wherein the conveying device comprises:

a fixing system which fixes the shipping box in the padding segment at a padding position at least during a period in which at least one padding item is inserted into the associated unused space.

3. The padding station according to claim 1, comprising:

a hold-down device for fixing the at least one shipping product in the shipping box, at least during the arrangement of at least one padding item.

4. The padding station according to claim 1, wherein at least one machine-trained function operates the conveying system, the plurality of padding item dispensers, and the handling system according to the sensor information associated with the pre-packed shipping box.

5. A padding system comprising a plurality of, padding stations according to claim 1.

6. The padding system according to claim 5, wherein at least two padding stations are connected in succession.

7. The padding system according to claim 5, wherein at least two padding stations are connected in parallel with one another.

8. A method comprising:

determining sensor information which is associated with a pre-packed shipping box, which is pre-packed with at least one shipping product, wherein the determined sensor information characterizes a position of each unused space within the at least one pre-packed shipping box;

conveying the at least one pre-packed shipping box out of an inlet segment and into a padding segment;

providing a plurality of padding items, of different types and/or sizes, in at least one dispensing segment according to the determined sensor information associated with the at least one shipping box;

receiving each of the plurality of padding items provided in the at least one dispensing segment according to the determined sensor information; and arranging each of the received items of the plurality of padding items in one of the free unused spaces within the at least one pre-packed shipping box positioned in the padding segment according to the determined sensor information;

determining at least one padding configuration associated with the pre-packed shipping box according to the sensor information; and wherein the providing of at least one padding item, receiving of the at least one padding item, and arranging of the at least one padding item are performed according to the determined padding configuration;

wherein the determination of the at least one padding configuration comprises:

determining a plurality of padding configurations and corresponding confidence values associated therewith, by means of differently machine-trained and/or differently configured functions, differing in their structure;

selecting a padding configuration from the plurality of padding configurations according to the confidence values, selecting the padding configuration with the highest confidence value; and wherein the providing of the at least one padding means, receiving of the at least one padding means, and arranging of the at least one padding means are performed according to the selected padding configuration.

9. The method according to claim 8, wherein the determination of the at least one padding configuration comprises:

determining at least one first data set of at least one padding item parameter relating to the padding item to be provided, and at least one unused space parameter relating to the associated unused space of the shipping box;

determining at least one target degree of conformity between the determined at least one padding item parameter and the at least one unused space parameter;

comparing the first data set and the at least one target degree of conformity with a previously determined second data set which comprises at least one previously determined padding item parameter and at least one unused space parameter, and also contains an actual degree of conformity associated with the second data set; and selecting the determined first data set for carrying out padding if the comparison indicates sufficient padding quality, or again determining the first data set and the target degree of conformity if the comparison does not indicate sufficiently good padding quality.

10. The method according to claim 8, wherein at least one machine-trained function determines the at least one padding configuration associated with the pre-packed shipping box according to the at least one piece of sensor information.

11. The method according to claim 8, wherein the padding configuration comprises one or more padding steps ordered in a temporal sequence, and wherein one of the padding steps comprises at least one padding parameter relating to the padding items to be provided, and also an unused space parameter, relating to the position within the empty unused space where at least one associated padding item to be provided should be inserted.

12. The method according to claim 8, comprising:

determining a further piece of sensor information associated with the at least one shipping box, which characterizes at least one position of at least one padding item arranged in the unused space of the shipping box.

13. The method according to claim 8, wherein determining the padding quality associated with the at least one padding item comprises determining an actual degree of conformity between at least one padding parameter-relating to the provided padding items and the associated unused space parameter relating to the unused space associated with the padding items.

14. A padding station or a padding system comprising a plurality of padding stations designed to carry out the method according to claim 8.

15. A computer program product which is designed to execute the method according to claim 8.

16. A non-volatile memory on which the computer program product according to claim 15 is stored.

17. A padding station configured to perform the method of claim 8.

18. A method comprising:

determining sensor information which is associated with a pre-packed shipping box, which is pre-packed with at least one shipping product, wherein the determined sensor information characterizes a position of each unused space within the at least one pre-packed shipping box;

conveying the at least one pre-packed shipping box out of an inlet segment and into a padding segment;

providing a plurality of padding items, of different types and/or sizes, in at least one dispensing segment according to the determined sensor information associated with the at least one shipping box;

receiving each of the plurality of padding items provided in the at least one dispensing segment according to the determined sensor information; and arranging each of the received items of the plurality of padding items in one of the free unused spaces within the at least one pre-packed shipping box positioned in the padding segment according to the determined sensor information;

determining at least one padding configuration associated with the pre-packed shipping box according to the sensor information; and wherein the providing of at least one padding item, receiving of the at least one padding item, and arranging of the at least one padding item are performed according to the determined padding configuration;

determining the corresponding availability of padding items for each of the plurality of padding item dispensers; and wherein the determination of the at least one padding configuration associated with the pre-packed shipping box is additionally carried out according to the determined availability of padding items.

19. A padding station configured to perform the method of claim 18.

20. A method comprising:

determining sensor information which is associated with a pre-packed shipping box, which is pre-packed with at least one shipping product, wherein the determined sensor information characterizes a position of each unused space within the at least one pre-packed shipping box;

conveying the at least one pre-packed shipping box out of an inlet segment and into a padding segment;

providing a plurality of padding items, of different types and/or sizes, in at least one dispensing segment according to the determined sensor information associated with the at least one shipping box;

receiving each of the plurality of padding items provided in the at least one dispensing segment according to the determined sensor information; and arranging each of the received items of the plurality of padding items in one of the free unused spaces within the at least one pre-packed shipping box positioned in the padding segment according to the determined sensor information;

determining at least one padding configuration associated with the pre-packed shipping box according to the sensor information; and wherein the providing of at least one padding item, receiving of the at least one padding item, and arranging of the at least one padding item are performed according to the determined padding configuration;

determining and checking a confidence value which represents an estimate for the actual applicability of the determined padding configuration to the pre-packed shipping box, according to the at least one piece of sensor information;

providing, receiving and arranging at least one padding item if the confidence value indicates the applicability of the padding configuration, or separating out the pre-packed shipping box in a separating segment if the confidence value does not indicate applicability of the padding configuration.

21. A padding station configured to perform the method of claim 20.

22. A method comprising:

determining sensor information which is associated with a pre-packed shipping box, which is pre-packed with at least one shipping product, wherein the determined sensor information characterizes a position of each unused space within the at least one pre-packed shipping box;

conveying the at least one pre-packed shipping box out of an inlet segment and into a padding segment;

providing a plurality of padding items, of different types and/or sizes, in at least one dispensing segment according to the determined sensor information associated with the at least one shipping box;

receiving each of the plurality of padding items provided in the at least one dispensing segment according to the determined sensor information; and arranging each of the received items of the plurality of padding items in one of the free unused spaces within the at least one pre-packed shipping box positioned in the padding segment according to the determined sensor information;

determining a further piece of sensor information associated with the at least one shipping box, which characterizes at least one position of at least one padding item arranged in the unused space of the shipping box;

determining and checking a padding quality associated with the at least one padding item according to the at least one further piece of sensor information; and transporting the shipping box to an output segment for transfer to a subsequent station if there is sufficient padding quality, or separating out the shipping box provided with padding items in a separating segment if there is insufficient padding quality.

23. A padding station configured to perform the method of claim 22.

24. A method comprising:

determining sensor information which is associated with a pre-packed shipping box, which is pre-packed with at least one shipping product, wherein the determined sensor information characterizes a position of each unused space within the at least one pre-packed shipping box;

conveying the at least one pre-packed shipping box out of an inlet segment and into a padding segment;

providing a plurality of padding items, of different types and/or sizes, in at least one dispensing segment according to the determined sensor information associated with the at least one shipping box;

receiving each of the plurality of padding items provided in the at least one dispensing segment according to the determined sensor information; and arranging each of the received items of the plurality of padding items in one of the free unused spaces within the at least one pre-packed shipping box positioned in the padding segment according to the determined sensor information;

wherein receiving the at least one padding item comprises:

determining a gripping pose, wherein the gripping pose comprises gripping by a gripper of the handling system in a segment of the padding items which is opposite a planned insertion segment of the padding items for insertion into the associated unused space; and gripping the at least one padding item according to the determined gripping pose.

25. A padding station configured to perform the method of claim 24.

26. A method comprising:

determining sensor information which is associated with a pre-packed shipping box, which is pre-packed with at least one shipping product, wherein the determined sensor information characterizes a position of each unused space within the at least one pre-packed shipping box;

conveying the at least one pre-packed shipping box out of an inlet segment and into a padding segment;

providing a plurality of padding items, of different types and/or sizes, in at least one dispensing segment according to the determined sensor information associated with the at least one shipping box;

receiving each of the plurality of padding items provided in the at least one dispensing segment according to the determined sensor information; and arranging each of the received items of the plurality of padding items in one of the free unused spaces within the at least one pre-packed shipping box positioned in the padding segment according to the determined sensor information;

wherein arranging the at least one padding item comprises:

determining a first trajectory starting from a receiving position, in which the padding item was gripped by the handling system in the at least one dispensing segment, to an intermediate position, in which the gripped padding item is situated in front of an outer opening of the associated free unused space;

determining a second trajectory starting from the intermediate position to an end position in which the padding item is arranged within the associated unused space;

moving the gripped padding item along the first trajectory to the intermediate position; and moving the gripped padding item along the second trajectory.

27. The method according to claim 26, comprising:

determining and checking an actual counterforce during the moving along the second trajectory; and moving the gripped padding item along the second trajectory as long as the actual counterforce is below a counterforce threshold value, or terminating the movement along the second trajectory if the determined actual counterforce exceeds the counterforce threshold value.

28. A padding station configured to perform the method of claim 26.

29. A method comprising:

determining sensor information which is associated with a pre-packed shipping box, which is pre-packed with at least one shipping product, wherein the determined sensor information characterizes a position of each unused space within the at least one pre-packed shipping box;

conveying the at least one pre-packed shipping box out of an inlet segment and into a padding segment;

providing a plurality of padding items, of different types and/or sizes, in at least one dispensing segment according to the determined sensor information associated with the at least one shipping box;

receiving each of the plurality of padding items provided in the at least one dispensing segment according to the determined sensor information; and arranging each of the received items of the plurality of padding items in one of the free unused spaces within the at least one pre-packed shipping box positioned in the padding segment according to the determined sensor information;

fixing, the at least one shipping product which bounds the free unused space, at least during the movement of the gripped padding item along the second trajectory.

30. A padding station configured to perform the method of claim 29.

* * * * *